US009617107B2

(12) United States Patent
Middelberg

(10) Patent No.: US 9,617,107 B2
(45) Date of Patent: Apr. 11, 2017

(54) WEB-GUIDING OR SHEET-GUIDING MACHINE, AND METHOD OF OPERATING THE SAME

(71) Applicant: Windmoeller & Hoelscher, Lengerich (DE)

(72) Inventor: Gerhard Middelberg, Lengerich (DE)

(73) Assignee: WINDMOELLER & HOELSCHER KG, Lengerich (DE)

( * ) Notice: Subject to any disclaimer, the term of this patent is extended or adjusted under 35 U.S.C. 154(b) by 323 days.

(21) Appl. No.: 13/973,060

(22) Filed: Aug. 22, 2013

(65) Prior Publication Data

US 2014/0175142 A1 Jun. 26, 2014

Related U.S. Application Data

(63) Continuation of application No. 12/083,333, filed as application No. PCT/EP2006/011525 on Dec. 1, 2006, now abandoned.

(30) Foreign Application Priority Data

Dec. 20, 2005 (DE) ..... 10 2005 061 241

(51) Int. Cl.

| | |
|---|---|
| ***B65H 26/02*** | (2006.01) |
| ***B65H 23/192*** | (2006.01) |
| *B41F 33/00* | (2006.01) |
| *B65H 26/00* | (2006.01) |

(52) U.S. Cl.

CPC ..... *B65H 23/192* (2013.01); *B65H 26/02* (2013.01); *B41F 33/00* (2013.01); *B65H 26/00* (2013.01); *B65H 2601/26* (2013.01)

(58) Field of Classification Search

CPC .... B65H 23/044; B65H 23/192; B65H 26/02; B65H 26/025; B65H 26/04

See application file for complete search history.

(56) References Cited

U.S. PATENT DOCUMENTS

| | | | |
|---|---|---|---|
| 3,047,198 | A | 7/1962 | Long |
| 3,104,845 | A | 9/1963 | Patterson, Jr. et al. |
| 3,164,333 | A | 1/1965 | Robertson |
| 3,323,700 | A | 6/1967 | Epstein et al. |

(Continued)

FOREIGN PATENT DOCUMENTS

| | | |
|---|---|---|
| DE | 196 00 110 | 7/1997 |
| DE | 100 27 442 | 12/2001 |

(Continued)

*Primary Examiner* — Michael McCullough

(74) *Attorney, Agent, or Firm* — Jacobson Holman, PLLC.

(57) ABSTRACT

A web-guiding or sheet-guiding machine has at least one roller nip, and at least one roller, which delimits the roller nip or is located downstream of the roller nip on a transport path, that is driven by an electric drive. A power controller is assigned to the electric drive, and the machine has a safety device to monitor whether foreign bodies are penetrating the roller nip and/or whether a specified torque for the drive is being maintained. The safety device has a first measuring device to monitor at least one first electric variable of the power to the drive by the power controller, a second measuring device to measure a second physical variable having a functional relationship with the first electric variable, and a computer module to compare time sequences of the two variables and generate warning signals in the event of deviations in the time sequence.

5 Claims, 1 Drawing Sheet

(56) References Cited

U.S. PATENT DOCUMENTS

| | | | |
|---|---|---|---|
| 6,106,177 | A | 8/2000 | Siegl et al. |
| 6,433,499 | B1 | 8/2002 | Cote et al. |
| 6,604,661 | B2 | 8/2003 | Feller et al. |
| 2002/0008129 | A1 | 1/2002 | Feller et al. |

FOREIGN PATENT DOCUMENTS

| | | |
|---|---|---|
| DE | 103 21 600 | 12/2004 |
| DE | 103 21 642 | 1/2005 |
| EP | 0 976 674 | 2/2000 |
| EP | 1 211 495 | 6/2002 |
| WO | WO 2004/101406 | 11/2004 |

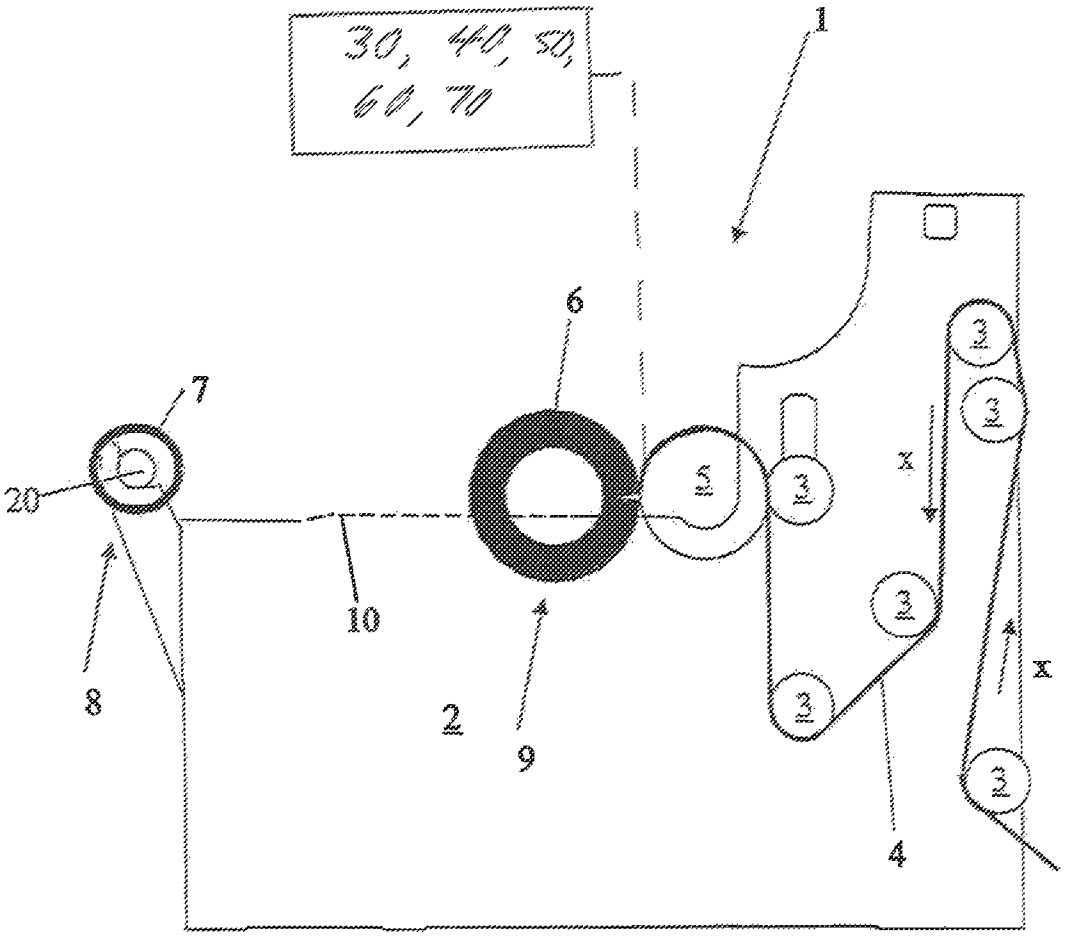
1
30, 40, 50,
60, 70
5
3
3
3
3
3
3
6
9
2
10
7
20
8
4
x
x

WEB-GUIDING OR SHEET-GUIDING MACHINE, AND METHOD OF OPERATING THE SAME

CROSS-REFERENCE TO RELATED APPLICATIONS

This application is a continuation application of U.S. application Ser. No. 12/083,333, filed Apr. 10, 2008, now abandoned, the disclosure of which is incorporated by reference as if fully set forth herein. The aforementioned U.S. application Ser. No. 12/083,333 is a nationalization of PCT/EP06/011525 filed Dec. 1, 2006 and published in German, which claims priority to DE 10 2005 061 241.5, filed Dec. 20, 2005.

BACKGROUND OF THE INVENTION

1. Field of Invention

The invention relates to a web-guiding or sheet-guiding machine and a method of operating such a machine. Web-guiding or sheet-guiding machines are used in extremely diverse areas of technology. These machines usually include printing machines and laminators. Machines of this type likewise include those used for winding or unwinding webs and oscillating units. Film extrusion systems also have film-transport rollers and squeeze rollers, which are upstream of the winding devices, if any.

2. Description of the Prior Art

All these machines have a plurality of transport rollers and often also roller nips. The term "roller nip" here is meant to connote a small distance between two rollers, which does not exceed the safety regulations laid down by the law or professional associations in the respective technical field or the respective country or which suggests safety precautions based on other considerations. In Germany, special safety precautions apply in this connection that necessitate special safety measures if the roller nip exceeds 120 mm. This is intended, for example, to prevent operating personnel from getting their limbs crushed in the roller nip or to mitigate the consequences of such crushing hazards.

Most roller nips in the machines cited above by way of example are characterized by a direct mechanical contact between the transported material (inter alia sheets or webs) and the two rollers. This is the case, for example, between the printing substrate and printing plates and impression cylinder during the operation of the machine. In a surface winder, such a situation exists particularly between the contact roller and the winding core during normal winding operation.

The transport of the webs or sheets through this roller nip is usually determined by the rotary motion of the webs delimiting the roller nip or the rotary motion of at least one subsequent roller. This at least one roller provides the torque required for transporting the material through the nip. Therefore, at least one of these rollers is driven by an electric drive.

Electric machines of a wide variety of designs are used for this purpose in printing machines, winders, and packaging machines. These electric machines include synchronous or asynchronous electric motors, and DC-operated electric motors are also common.

These electric drives 30 can be provided with power controllers that make available the appropriate form of electric power for the motor.

As mentioned above, the roller nips are subject to observation for safety reasons. For this purpose, crush barriers and/or light barriers, which can generate a "Stop signal" for the drives of the relevant rollers, are often used in front of the roller nips.

Another option for preventing crushing hazards in roller nips while simultaneously ensuring the maximum possible accessibility of the roller nip consists in reasonably limiting the torque of the at least one roller, which provides the torque for transporting the webs or sheets through the roller nip. This can be accomplished by limiting—usually controlling—the torque-generating current. In this manner, it could be possible to operate the roller at a torque that does not exceed hazardous levels. However, an "Emergency stop" is also possible as a result of an increase in torque. Such an increase in torque can be triggered by a foreign body—such as a hand—in the roller nip.

Commercially available power controllers, which also include frequency inverters for three-phase motors or alternating current motors, also have the option of measuring the current at one of their outputs. So-called "shunts," thus backup resistors, are often provided for this purpose. This measurement can form the basis of the torque control or emergency stop.

However, it has been seen that a current measurement using only one measuring system 50 involves safety risks. It may happen that such a measuring system measures inaccurately or does not measure at all and thus signals excessively low actual values of current to the power controller or control device. Consequently, the current regulator supplies an excessively high torque-generating current to the related drive. The drive would thus be able to generate an excessively high torque and the entire safety device would be worthless.

SUMMARY OF THE INVENTION

It is the object of the present invention to suggest a machine in which the maintaining of a specified torque and/or the observation of increases in torque is monitored more reliably.

This object is achieved in that the safety device 40 comprises a second measuring device 60, which can measure a second physical variable having a functional relationship with the first electric variable, and that the safety device comprises a computer module 70 by means of which the time sequences of the two variable can be compared with one another and warning signal can be generated in the event of deviations in the time sequence.

BRIEF DESCRIPTION OF THE DRAWINGS

The drawing FIGURE illustrates a side view of a winding device for the winding up of a material.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The drawing FIGURE illustrates a side view of a winding device 1 for the winding up of a material sheet 4 into a roll 6. For this purpose, the material sheet 4 is guided over several deflector rollers 3 that are mounted in a machine frame 2. Subsequently, the material sheet 4 is guided over a contact roller 5 and then rolled up into the roll 6. The contact roller 5 is pressed against the roll in a known manner so that the material sheet 4 is rolled up using a predetermined tension. A new winding sleeve 7, which is fitted on a winding sleeve support 20, is located in a preparation state 8. The new winding sleeve 7 can be conveyed over bearing rails 10 into a winding position 9 after the removal of the completely formed roll 6.

A variable, which has a functional relationship with the first electric variable, is advantageously selected as the second physical variable. The second physical variable thus particularly includes mechanical variables such as the web speed or the web tension, which react rapidly and for comprehensible reasons to a variation in the torque of a relevant transport roller. However, this does not mean that there must exist a simple, analytical relationship, for example, between the torque and the web tension. Due to the plurality of factors influencing these variables, this functional relationship is also quantifiable using only empirical values and can be stored in the form of a calibration table by way of example.

Many web-processing machines already have devices for measuring these mechanical variables. The web speed is measured particularly in printing machines, but also in winders by means of rotary transducers on rollers and also using all types of non-contact sensors. These non-contact sensors also include optical sensors, which register the passage of register marks by way of example. All types of sensors can be connected to suitable evaluation modules.

Compensating rollers can be used for measuring the web tension. Compensating rollers are often already provided in web-guiding machines in order to keep the web tension constant. For this purpose, they are suspended such that they can assume variable positions. A force is exerted on the axis of the compensating roller, for example, by means of a pneumatic cylinder. This force influences the web tension. The change in the position of the compensating roller as a result of fluctuations in the web tension can be recorded, for example, using position sensors so that information on the web tension may be acquired.

Measuring rollers, the axes of which operatively interact with force-measuring devices, can be advantageously used for measuring the web tension.

Measured variables other than mechanical ones can also be used as "second physical variables." A second current-measuring device can thus be simply connected downstream of a first current-measuring device for measuring the torque-generating current. However, it could be more advantageous to measure another related electric variable in the second measurement. Thus, different "current indicator components" could be measured by both measuring systems, for example, in a three-phase system. A deviation in these components can also be traced back to errors or sudden changes in torque requirements. The application of different current-measuring principles can also involve advantages. Thus, for example, a non-isolated shunt measurement present by default on a frequency inverter can be supplemented by a potential-free current measurement using a magnetic field-measuring device (e.g., Hall sensor or magneto-resistive sensor) as a second measurement. Such measures would reduce the susceptibility of the measurement to individual causes of error.

In the application of two measuring systems for monitoring the roller nip, the "hierarchy" of both measuring systems can be advantageously designed to be variable. In two measuring systems that respond equally rapidly or are even similar in nature, the measured values can be processed with equal priority. Thus, when using two current-measuring systems during normal operation of the winder, warning signals could be generated even in case of a small number of deviating measured values so that the defective sensor is replaced. It can be advantageous to let a control device trigger an "emergency signal" in such a system as soon as any of the two measuring systems indicates a steep increase in torque.

In a combination of a rapidly responding measuring system with a slowly operating measuring system, it is usually advantageous to exclusively let the former trigger the "Emergency stop" function. It is then the task of the slowly responding measuring system to regularly provide measured values with the help of which the correct functioning of the rapidly responding measuring system is monitored. This possibility may be preferable in a combination of a measurement of the torque-generating current with a measurement of characteristics of web mechanics since variables such as web tension and web speed usually change slowly.

The intervals between the transmission of measured values of the monitoring measuring system can by all means be very long compared to the response time of the monitored system. It may be possible to meet many safety regulations if the intervals between such measurements were of approximately one hour each. Irregular intervals are also conceivable.

It should be generally pointed out here that it could be advantageous in all embodiments of the invention to effect an emergency stop or any other automatic safety measure based on a warning signal in order to transfer the machine into a safer condition.

Against the background of the invention, the computer module, using which the time sequences of the two variables are compared with each other, can be variably formed both from the hardware side and the software side. The term "computer module" here refers to any component, thus any module, which, by its function, can complete this task of comparing the time sequences of the two variables. In an advantageous embodiment of the invention, two such modules can be provided for redundancy and for further increasing safety against breakdown.

Such a module can resort to the often already existing CPU of the power controller—which is often a commercially available frequency inverter. These hardware components can be easily improved in such a way by the application of software that they can fulfill the required function. Suitable hardware components are usually also to be found on the machine itself. These are often controlled from an industrial computer. Such hardware units can also be programmed to take on the role of the control module. A functional pair comprising a control module in the frequency inverter and a control module in the control computer constitutes an advantageous refinement of the invention.

Additional exemplary embodiments of the invention are defined herein.

The illustration of machines can be dispensed with in the present context. However, the following documents are incorporated herein by reference, in relation to web-winding devices, which can be further refined using the method suggested by this invention and which comprise roller nips by way of example: DE 103 21 601, DE 103 21 642, and DE 103 21 600.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A web guiding or sheet guiding machine, in which webs or sheets are conveyed along a transport path (z), comprising:

a first roller and a second roller, with at least one of the first roller and the second roller being drivable by an electric drive, the electric drive having associated therewith a power controller, with a roller nip bounded by the first roller and the second roller; and a safety device to monitor at least one of whether foreign bodies are penetrating into the roller nip and whether a specified torque for the electric drive is being maintained, the safety device including (i) a first measuring device to monitor an electrical variable of power made available to the electric drive by the power controller, (ii) a second measuring device to measure a physical variable having a functional relationship with the electrical variable, and (iii) a computer module to compare time sequences of the electrical variable and the physical variable with each other, and, based on any deviations in the compared time sequences, to generate alarm signals, the first measuring device monitoring a torque-forming current, and the second measuring device monitoring the physical variable, with the physical variable being selected from at least one of a tension and a speed associated with the conveyed webs or sheets, and, based on the measured values of the second measuring device, monitoring a correct function of the first measuring device, with the electrical variable of the power monitored by the first measuring device serving as a basis for an alarm signal that initiates an emergency interruption in operation of the web guiding or sheet guiding machine, and with a time interval between a transmission of monitored values of the second measuring device being substantially greater than a time interval between a transmission of monitored values of the first measuring device.

2. The machine according to claim 1, wherein the second measuring device includes at least one of a rotary encoder, a contactless, web-detecting sensor, a compensator roller, and a measuring roller with a force measuring device.

3. The machine according to claim 1, wherein the second measuring device includes at least one of measuring means and control modules to assess an influence of characteristics of the conveyed webs or sheets.

4. The machine according to claim 1, wherein the second measuring device measures mechanical and electrical variables.

5. A method of operating a web guiding or sheet guiding machine in which webs or sheets are conveyed along a transport path, the machine having a first roller and a second roller, with at least one of the first roller and the second roller being drivable by an electric drive, the electric drive having associated therewith a power controller, a roller nip bounded by the first roller and the second roller, and a safety device to monitor at least one of whether foreign bodies are penetrating into the roller nip and whether a specified torque for the drive is being maintained, the safety device including (i) a first measuring device to monitor an electrical variable of power made available to the drive by the power controller, (ii) a second measuring device to measure a physical variable having a functional relationship with the electrical variable, and (iii) a computer module to compare time sequences of the electrical variable and the physical variable, and, based on any deviations in the compared time sequences, to generate alarm signals, the method comprising the steps of monitoring with the first measuring device a torque-forming current, monitoring with the second measuring device the physical variable, with the physical variable being selected from at least one of a tension and a speed associated with the conveyed webs or sheets, and, based on the measured values of the second measuring device, monitoring a correct function of the first measuring device, with the electrical variable of the power monitored by the first measuring device serving as a basis for an alarm signal that initiates an emergency interruption in operation of the web guiding or sheet guiding machine, and with a time interval between a transmission of monitored values of the second measuring device being substantially greater than a time interval between a transmission of monitored values of the first measuring device.

* * * * *